United States Patent [19]

Martin

[11] 4,027,796

[45] June 7, 1977

[54] STACKABLE AND NESTABLE CONTAINER

[75] Inventor: Sam M. Martin, Toronto, Canada

[73] Assignee: Consumers Glass Company Limited, Etobicoke, Canada

[22] Filed: Dec. 1, 1975

[21] Appl. No.: 636,634

[52] U.S. Cl. ..... 206/507

[51] Int. Cl.[2] ..... B65D 21/04

[58] Field of Search ..... 206/507

[56] References Cited

UNITED STATES PATENTS

| | | | |
|---|---|---|---|
| 3,270,913 | 9/1966 | Briderstine | 206/507 |
| 3,481,507 | 12/1969 | Sanders | 206/507 |
| 3,773,213 | 11/1973 | Frederick | 206/507 |

*Primary Examiner*—George E. Lowrance

[57] ABSTRACT

A container which is adapted to be stacked and nested vertically with a container of substantially identical shape is disclosed. The container has two pairs of interconnected opposed upright walls and a bottom wall to provide an open top container. A pair of the upright walls has inwardly projecting flutes, the upper portion of each flute presenting a support surface. Stacking guidance and engagement means are provided on the container to guide the stacking of an upper container down onto a lower container to bring the engagement means of the containers into engagement to ensure a proper stacking of the container. Means is provided on the container to preclude an upper container binding in a lower container when like containers are nested. The container is provided with ventilation means for ventilating the container interior and also drainage means for draining liquid from the container interior.

11 Claims, 10 Drawing Figures

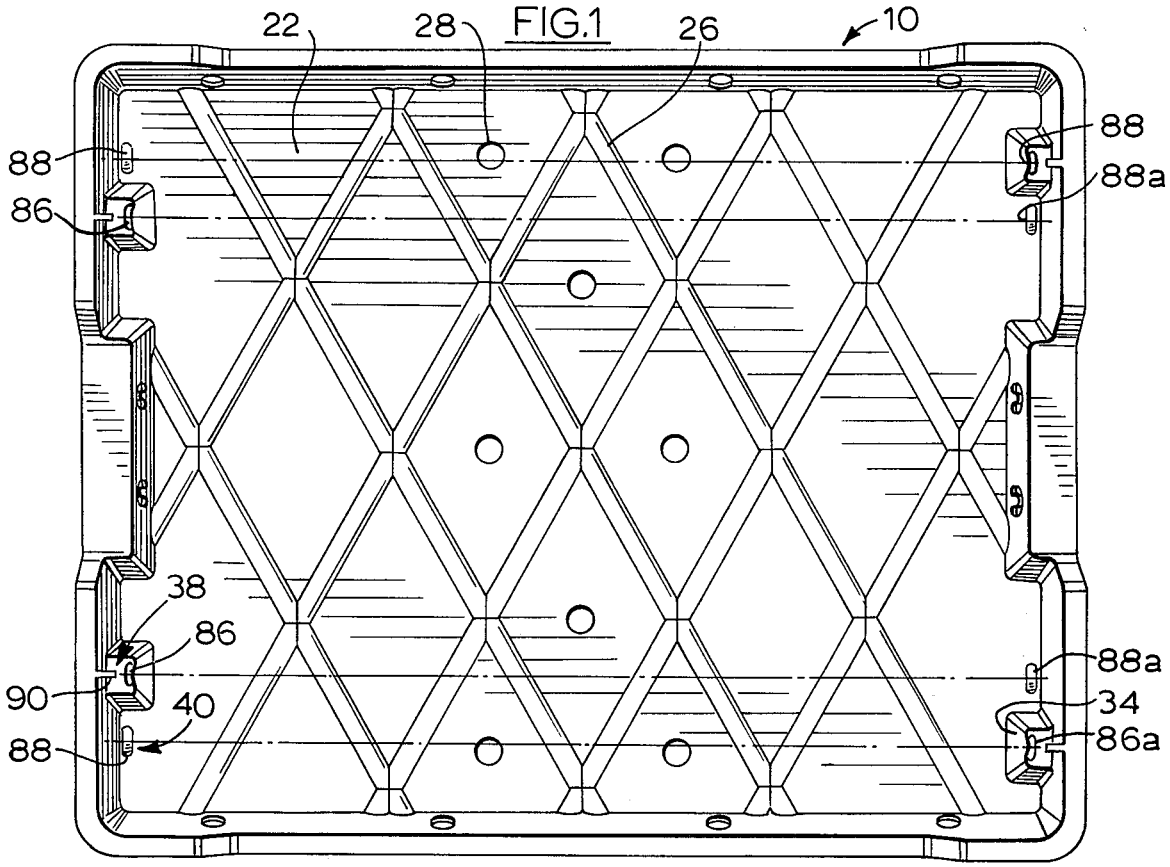
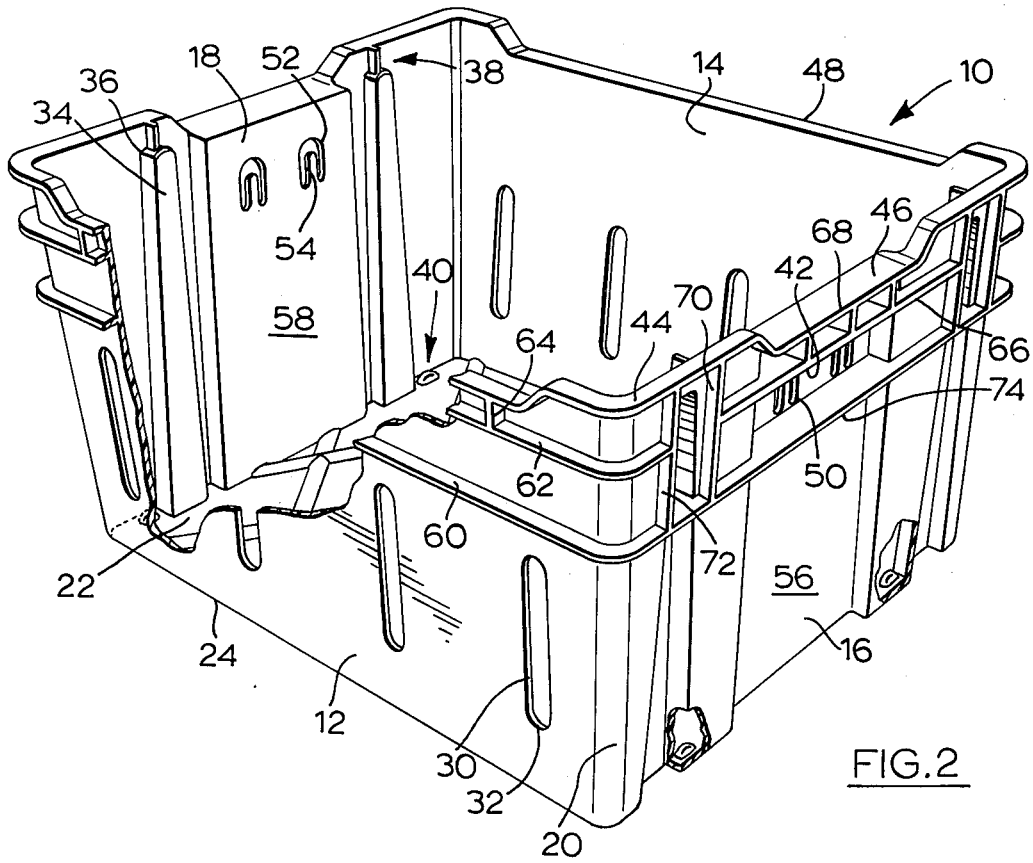
FIG.2

FIG. 7
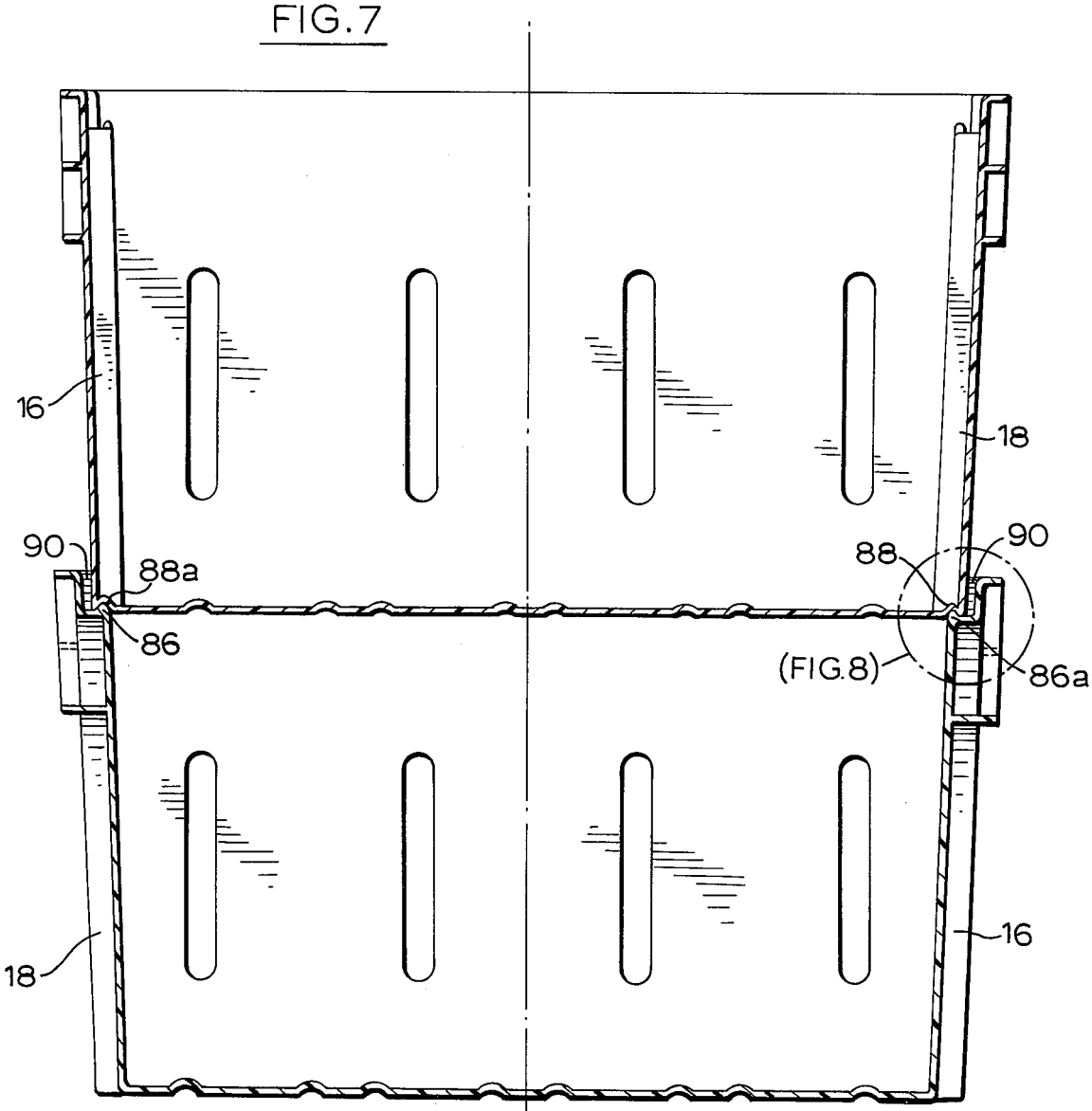
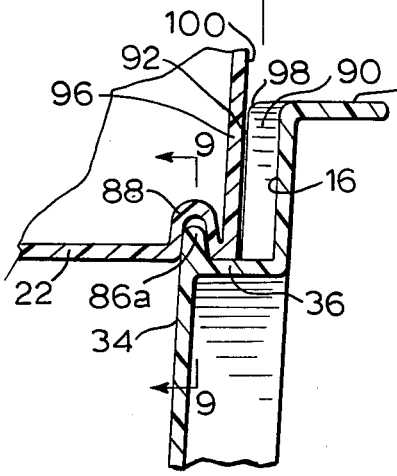
FIG. 8
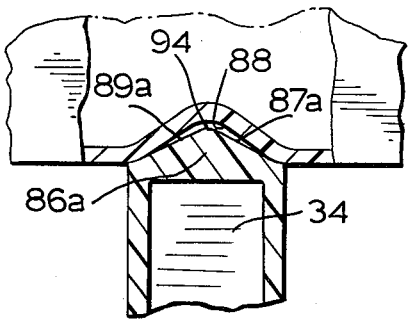
FIG. 9

STACKABLE AND NESTABLE CONTAINER

FIELD OF THE INVENTION

This invention relates to open top containers which are adapted to be stacked and nested vertically with like containers and, more particularly, to a container provided with means for guiding the stacking of an upper container down onto a lower container to ensure proper stacking of the containers.

BACKGROUND OF THE INVENTION

In the stacking of like containers, particularly those containing fragile goods, the containers should be properly stacked so that an upper container does not accidentally drop into a lower container to cause damage to the contained goods. The container should therefore be of a configuration which ensures proper stacking of like containers and which has a usable volume for containing different types of materials and also has sufficient structural strength to support the stacking of several like containers.

It is therefore an object of this invention to provide a container which is adapted to be stacked and nested vertically with a like container having stacking guidance and engagement means to ensure that stacked containers are properly located, one upon the other, to substantially reduce the risk of damaging contained fragile goods when like containers are stacked.

It is another object of the invention to provide a container which, when nested with a like container, is precluded from binding therein.

It is a further object of the invention to provide a re-usable container which may be used for containing produce and other objects where the container is of a moldable, formable material which is easily cleaned for re-use of the container.

It is yet a further object of the invention to provide stacking guidance and engagement means on a container which does not substantially interfere with the usable volume of a container.

It is another object of the invention to provide the aforesaid container with a smoothly shaped interior surface so that contained fragile goods are not damaged by the container interior surfaces.

It is a further object of the invention to provide structural reinforcement means on the exterior of the container so as to not interfere with the usable internal volume of the container.

It is another object of the invention to provide a re-usable container of the aforesaid type with means for ventilating and draining the container interior.

It is yet a further object of the invention to provide a produce container which has a shape of predetermined size and usable volume so that the container can be used to contain several different types of produce in an efficient manner.

It is still another object of the invention to provide a container of the aforesaid type where the lower portions of the side of the container and the bottom wall are free of any projections so as to permit use of the container on conveyor systems and the like.

It is another object of the invention to provide a stackable and nestable container which from a nested position, can be rotated 180° relative to a lower container and stacked thereon.

It is yet a further object of the invention to provide handles on the sides of the container which do not detract from the structural strength of the supporting side walls of the container and which are adapted to preclude insertion of fingers within the container and damaging contained fragile goods.

SUMMARY OF THE INVENTION

The container according to this invention is provided with stacking guidance and engagement means which ensures the proper stacking of an upper container onto a lower container so that the stacked containers can carry a substantial vertical load of even up to 500 lbs or more. Also, in ensuring proper stacking of the containers, the possibility of an upper container accidentally dropping into a lower container due to misalignment of stacked containers is eliminated thereby protecting the contained goods.

The stacking guidance and engagement means is provided on the container in a manner so as to leave the interior surfaces of the container free of any sharp edges. Structural reinforcement elements are provided on the exterior of the container to ensure that the internal surfaces of the container are smooth. It is understood, however, that when the container is used for metal parts and the like, changes and alterations may be made to the design of the stacking means and structural reinforcement members since in this circumstance, it is not imperative to have smooth internal surfaces.

The container is provided with means which precludes binding of an upper container in a lower container when like containers are nested for compact transport of them, thereby facilitating re-use of the containers.

The container according to this invention may have two pairs of opposed upright walls interconnected at their essentially vertical edges. Each pair of upright walls slope inwardly towards each other from top to bottom thereof. A bottom wall is connected to the lower essentially horizontal edges of the upright walls to provide an open top container. The sloped side walls permit the nesting of like containers. A pair of the upright walls has ventilation means provided therein for ventilating the container interior. The bottom wall of the container has drainage means for draining liquid from the container interior.

A pair of the upright walls each has inwardly projecting flutes extending upwardly from the bottom of the wall and terminating near the top thereof. The upper portion of each flute is closed to present a support surface.

Stacking guidance and engagement means is provided on the container and is adapted to guide the stacking of an upper container down onto a lower container by the interaction between the guidance portion of a lower container and a lower portion of the outer surfaces of two or more upper container upright walls. This guidance of container stacking registers the engagement portions of the upper and lower containers so that the portions engage in a manner to restrict movement between stacked containers in a substantially horizontal plane.

The support surface of each flute of a bottom container is adapted to support at least a portion of the bottom wall of an upper container.

The stacking guidance and engagement means of the container may be an integral unit or separate units. The guidance portion of the stacking guidance and engagement means may be of several different shapes where the underlying principle of operation of the guidance means is the interaction between the guidance portion of a lower container and the exterior surfaces of an upper container when like containers are stacked.

The container may be made out of moldable and formable material such as plastics and light metals. The design of the container is such to provide sufficient vertical strength to facilitate stacking of several like containers one upon the other. In addition, the containers may be easily washed and recycled for use in the field and are of a shape and design such that they are presentable for use in displaying goods in grocery stores and other distribution outlets.

The stacking guidance and engagement means may only be provided on a pair of opposing walls, so that the remaining pair of opposing walls are essentially planar. On the other hand, each pair of opposing walls of the container may have stacking guidance and engagement means provided thereon. With such a provision on a square container, it is only necessary to rotate the container 90° relative to a lower container for purposes of nesting or stacking like containers. Ventilation means may be provided in the essentially planar walls to properly ventilate the container interior and at the same time provide optimum insulation of the container interior when perishables are placed therein to facilitate distribution of produce which must be kept at lower temperatures.

DESCRIPTION OF THE DRAWINGS

These and other objects, advantages and features of the invention will become apparent in the following detailed description of several preferred embodiments according to this invention, as shown in the drawings wherein:

FIG. 1 is a top view of a container according to a preferred embodiment of this invention;

FIG. 2 is a perspective view of the container of FIG. 1 with a section of the side removed;

FIG. 7 is a section along lines 7—7 of FIG. 6;

FIG. 8 shows an enlarged view of the circled area of FIG. 7;

FIG. 9 is a section along lines 9—9 of FIG. 8;

FIG. 4 shows an alternative embodiment of the invention for precluding the binding of nested containers.

DETAILED DESCRIPTION OF THE PREFERRED EMBODIMENTS

Figure 3:
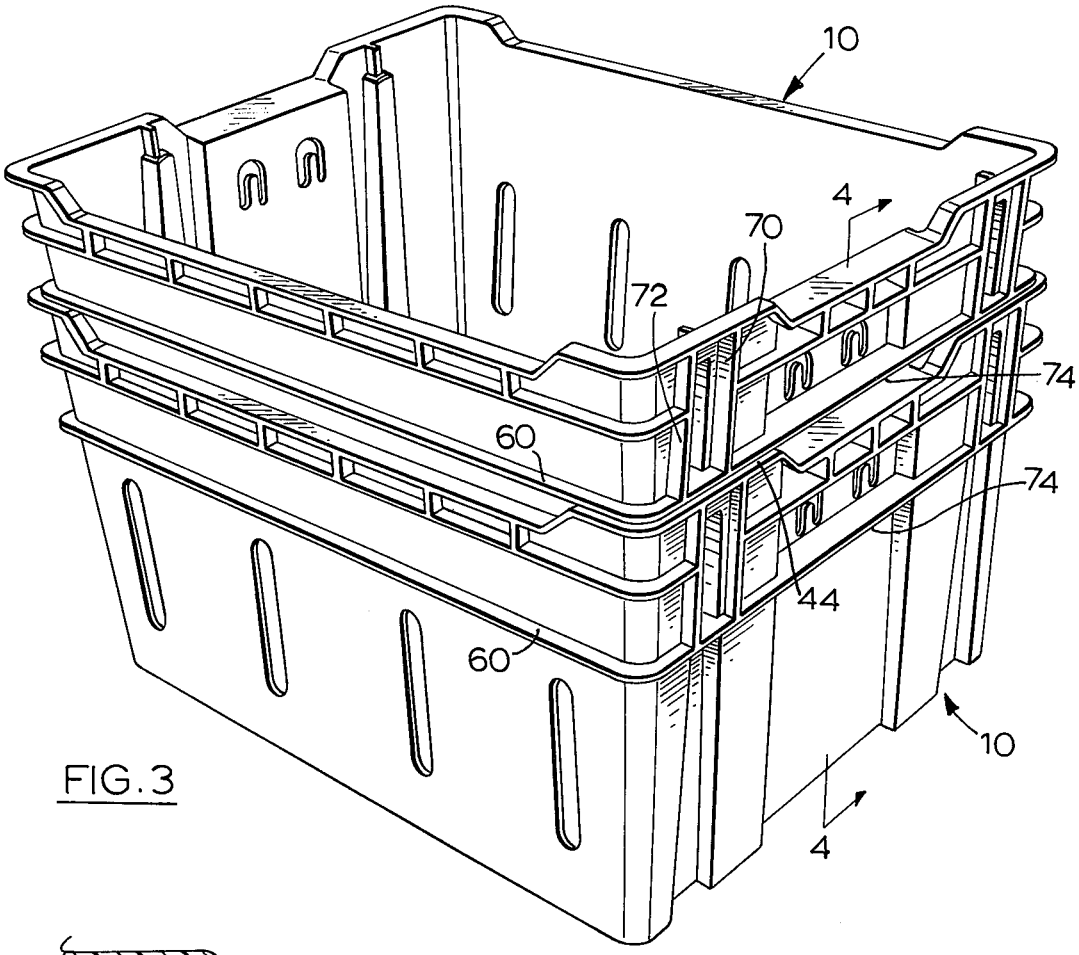
FIG. 3 is a perspective view of two containers according to this invention nested within each other.

Referring to FIGS. 1 and 2, a container according to this invention is shown which has two pairs of opposed upright walls 12, 14 and 16, 18. The upright walls are connected at their essentially vertical edges such as at 20. A bottom wall 22 is interconnected to the essentially horizontal lower edges of the container upright walls such as at 24. Each pair of upright walls 12, 14 and 16, 18 slope inwardly towards each other as shown in FIG. 2 to permit the nesting of containers as more clearly shown in FIG. 3.

The bottom wall 22 has a plurality of criss-crossing smoothly rounded raised ribs 26 provided therein, the purpose of which is to add structural reinforcing to the bottom wall to prevent bellying of the bottom wall when goods are placed therein. The bottom wall has cut therein a plurality of drainage holes or perforations 28 which facilitate the drainage of water and the like from the container interior.

Although opposed upright walls 12 and 14 are provided with four evenly spaced-apart slots 30 cut therein, it is understood that a greater or lesser number of slots may be cut in the sidewalls. In addition, the shape and size of the slots may be altered from that shown in the drawings. In a preferred embodiment, the lower edge of each slot 32 is spaced a substantial distance from the bottom of the container to preclude mud, dirt and the like entering the container as the container is dragged along in the field for picking produce. In such instances, the other set of opposed walls 16 and 18 is essentially free of any perforations or slots so as the container is dragged along by handles 42, mud does not enter into a container through container ends 16, 18. The purpose of slots 30 is to ventilate the container interior where the number, shape and size of slots is selected to provide optimum ventilation and, at the same time, optimum insulation of the cooled contents. In a preferred embodiment, the spacing between the slots is such that for example, when heads of lettuce are placed in the container, these slots are aligned with the areas of contact between the lettuce heads so that air may flow freely through the container. The number of slots is usually, however, kept to a minimum to provide insulation for the contained produce so that when the container is removed from the cooler, the rate at which the contained goods heat up is decreased.

A pair of opposed upright walls 16 and 18 are provided with inwardly projecting flutes 34 which extend upwardly from the bottom of a container and terminate near the top thereof as clearly shown in FIGS. 1 and 2. Each inwardly projecting flute 34 is tapered in an upward direction and is closed at the top to provide a support surface 36. In a preferred embodiment, the stacking guidance and engagement means is provided on support surface 36, generally designated at 38 and in the bottom of the container generally designated at 40.

Container upright walls 16 and 18 are provided with hand grip portions 42. No large openings are provided in the container near the hand grip portion so that insertion of the fingers into the container is prevented when the container is being manipulated. The upper edge of the container has a ledge portion 44 which is dropped down at 46 in the area of hand grip portion 42. Ledge portion 44 also drops down at 48 along a portion of walls 12 and 14. These lower portions of the ledge permit viewing into the container when like containers are stacked in the manner shown in FIG. 6.

The upright walls 16 and 18 are provided with card attachment means 50 which is adapted to receive a card by the provision of a perforation 52 with an upstanding post 54. These cards are readily displayed on the outer surfaces of the container to designate the type of contained goods and where the material is being shipped.

Beneath the hand grip portions 42, upright walls 16 and 18 each has respectively, an indented portion 56 and 58 which enhances structural strength of upright walls 16 and 18. In addition, the inwardly projecting flutes 34 add to the structural strength of the upright walls 16 and 18.

On the exterior of the container 10, integrally molded reinforcing ribs 60 and 62 are provided on upright walls 12, 14 and 16, 18 in the manner shown in FIG. 2. Ribs 62 are connected to upper ledge 48 by upright ribs 64. These external ribs substantially increase the structural strength of the upright walls 12 and 14 to increase the overall rigidity of the container to permit stacking of several containers. In addition, on upright walls 16 and 18, integrally molded reinforcing ribs 66 and 68 are provided to increase the structural rigidity of the hand grip portion 42 and of the upper portions of the walls 16 and 18. Projecting downwardly from ledge 44 are ribs 70 and 72 which are interconnected with the other ribs in the manner shown.

Figure 5:
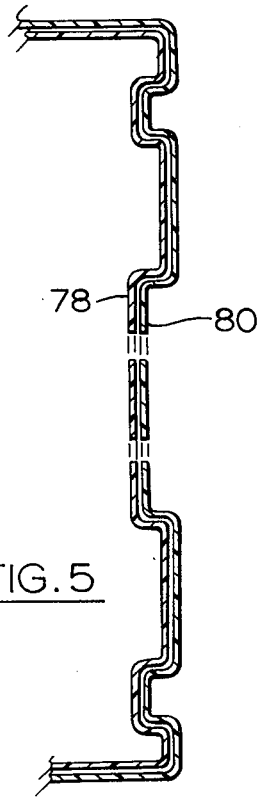
FIG. 5 is a section along lines 5—5 of FIG. 4.
Figure 4:
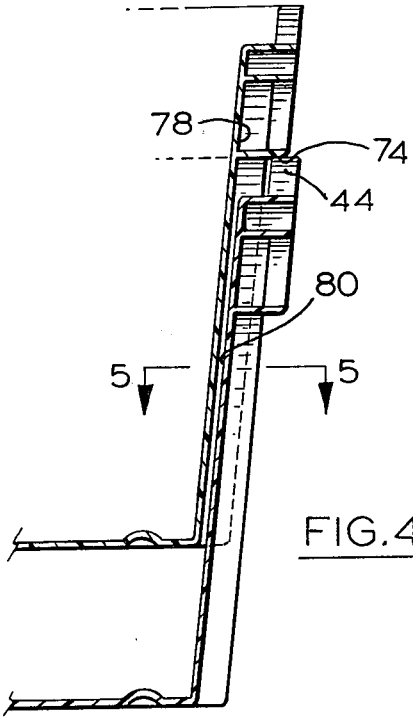
FIG. 4 is a section along lines 4—4 of FIG. 3.

Turning to FIG. 3, like containers 10 are nested one within the other where the underside 74 of rib 60 rests on ledge 44 in the area of each corner of the container. Rib 60 is located on the container so that binding between nested containers is prevented. Referring to FIG. 4, it can be seen that the underside 74 of rib 60 is resting on ledge 44 in a manner to leave a space between the exterior surface 78 of the upper container and the interior surface 80 of the lower container so that the containers do not bind. The space between the containers is more clearly shown in FIG. 5. With the space provided between the nested containers, this greatly facilitates separation of the nested containers to cut down on labour time spent in retrieving nested containers for re-use.

Figure 10:
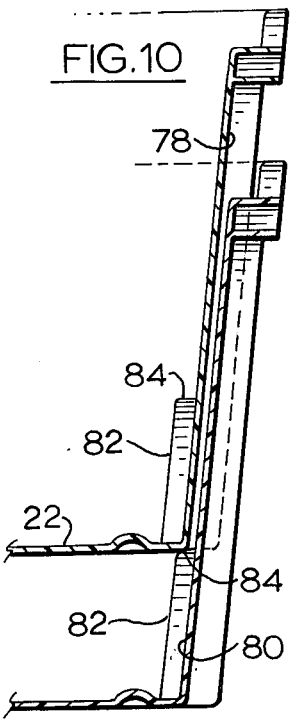
FIG. 10 which appears beside

An alternative embodiment for precluding binding of nested containers is shown in FIG. 10 where the interior surface 80 of the lower container is provided with vertical ribs 82 on the inner surface 80 thereof. The bottom wall 22 rests on the upper surface 84 of ribs 82 and is dimensioned so as to leave a space between the outer surface 78 of the upper container and the inner surface 80 of the lower container in the manner as discussed with reference to FIG. 5, so as to preclude binding of nested containers.

In a preferred embodiment, the stacking guidance and engagement means as shown in FIGS. 1 and 2 comprises a stacking projection 86 which fits into a stacking recess 88 provided in the bottom wall 22. Guidance ribs 90 are provided above each flute 34 and are integral with the inner surface of walls 16 and 18. As shown in FIG. 1, the flutes 34 on each wall 16 and 18 are symmetrical about the central longitudinal axis of the container 10 where recess 88 adjacent wall 18 is aligned with stacking projection **86*a* adjacent wall 16. Similarly, stacking recess 88*a* adjacent wall 16 is aligned with stacking projection 86 adjacent upright wall 18. Therefore as can be appreciated, when an upper container is taken from its nested position in a lower container of the arrangement shown in FIG. 3, and is rotated 180°, the stacking recesses 88 of the upper container will be in register with the stacking projections 86*a* in the diametrically opposed corner. Likewise, the stacking recesses 88*a* are in register with the respective stacking projections 86**.

Figure 6:
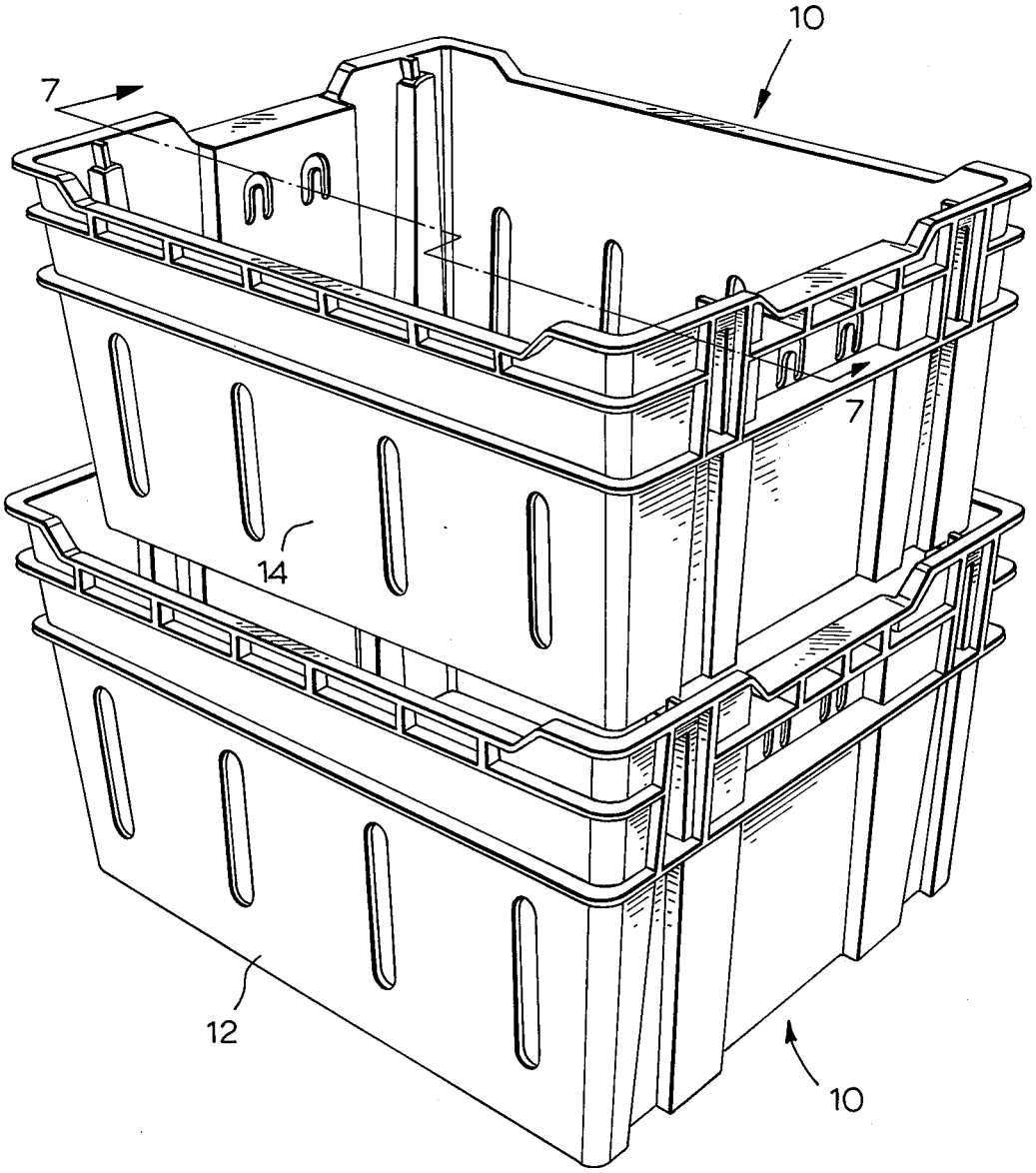
FIG. 6 is a perspective view of two containers according to this invention in stacked relationship.

Turning to FIG. 6, like containers 10 are shown in the stacked position where the stacking engagement means are engaged to restrict movement between stacked containers in substantially a horizontal plane. FIG. 7 shows stacking recess 88 of an upper container receiving the respective stacking projection **86*a*. Similarly, stacking recess 88*a* receives stacking projection 86. The relationship of upright walls 16 to 18 of the upper and lower containers is also more clearly shown in FIG. 7 and similarly the relationship of the upright walls 12 and 14 of the upper and lower containers is clearly shown in FIG. 6** when like containers are stacked.

The guidance means according to this invention ensures the proper stacking of containers. In the handling of the containers, the workmen may stack the containers in fairly rapid succession because of the assistance provided by the stacking guidance means. The interaction of the stacking guidance and engagement means is more clearly shown in FIGS. 8 and 9. Referring to FIG. 8, the upper portion of inwardly projecting flute 34 is closed off to provide a support surface 36. Integral with the interior surface of end wall 16 is a stacking guidance rib 90. The stacking guidance rib extends from ledge 44 downward to the support surface 36 and extends inwardly of the container to provide a vertical free end 92. The bottom 22 of the upper container has a stacking recess 88 which is shaped to receive the stacking projection **86*a*. In the preferred embodiments shown, the stacking projection 86*a* shown in FIG. 9 is an elongate lug with a raised portion 94 presenting inclined surfaces 87*a* and 89*a*. The inclined surfaces of stacking recess 88 interact with inclined surfaces 87*a* and 89*a* to center the stacking projection 86*a* in recess 88** and thereby guide the stacking of like containers so that the central longitudinal axes of stacked containers are aligned.

Although not shown, it is understood that alternative shapes and forms of stacking recesses and stacking projections may be used together with different shapes of stacking guidance ribs where the location of the stacking guidance ribs may be other than directly above the support surface 36. For example, the stacking guidance ribs may be located other than over flute 34 where they are positioned to interact with an upper container. For that matter, the function of the stacking projections and guidance ribs may be integral by providing a dome which would center the stacking of an upper container down onto a lower container in all directions while the upper portions of sidewalls of a lower container would function to initially guide the stacking of an upper container onto a lower container so that the side walls act as the guidance means.

Returning to FIG. 8, after the upper container of FIG. 7 is lowered downwardly towards the lower container, the exterior surfaces of upright walls 16 and 18 interact with the free ends 92 of stacking guidance ribs 90 where a relatively small space 96 is between the exterior surfaces of the upright walls and the free ends 92. The distance between the free ends 92 is such that the distance is slightly greater than the distance between the external surfaces of upright walls 16 and 18 thereby leaving a space 96. As the upper container is lowered, the free ends 92 of the guidance ribs 90 having rounded upper portions 98 interact with or contact the exterior surfaces 100 of the upright walls to place the stacking recess 88 over the stacking projection **86*a*. As the container is continued to be lowered, the inclined surfaces 87*a* and 89*a* of stacking projection 86*a* engage the inclined surfaces of stacking recess 88 and cam against each other to center the stacking recess 88 over the projection 86*a*. As a result, the stacking recess 88 is positively centered over the stacking projection 86*a* to ensure a positive engagement between the recess and projection. As can be appreciated, the remaining stacking projections and recesses are aligned in a similar manner to thereby ensure the proper stacking of like containers. With the containers properly stacked, a portion of the bottom wall 22 rests on the support surface 36 in the manner shown in FIG. 8 so that several containers may be stacked one upon the other. A major portion of the load of an upper container is transferred to the base of a lower supporting container by the walls of flutes 34.** The combined load of the upper and lower containers is transferred to yet another underlying supporting container by the portions of the bottom wall of the lower container resting on the support surfaces of the flutes of the underlying container. As a result, the load of several stacked containers is transferred directly to the bottom container which in turn has sufficient structural strength to withstand such loads because of the structural reinforcement provided on the container as already discussed.

The stacking guidance and engagement means according to this invention permits an operator to quickly and properly stack containers where the engagement means prevents the containers from slipping or moving out of their properly stacked positions. In addition, with this type of stacking guidance and engagement means, there is no requirement for extraneous or complex projections on the internal surfaces of the container so that the container internal surface is relatively smooth where all corners in the container are rounded so that the container is particularly adapted for use in handling soft produce such as tomatoes, apples, peaches and the like without damaging the contents. The container also has a very useful volume which may be readily used to contain several different types of produce such as apples, beets, broccoli, parsley, carrots, cabbage, cauliflower, celery hearts, celery stalks, lettuce, peppers and rutabagas.

The stacking and guidance means according to this invention leaves upright walls 12 and 14 of the container free of any indentation to permit the judicious and precise location of ventilation slots in the manner shown in FIG. 2 so as to optimize the rate of cooling the produce and the thermal insulation thereof once removed from the cooler. The width of the slots are predetermined by the degree of ventilation and insulating value required and the size of produce or goods to be carried so that the contained goods do not fall out of the container through the slots.

The stacking guidance means ensures that the stacking projections are received by the stacking recesses so that the flat bottom 22 of an upper container is not placed on a stacking projection which could cause puncturing of the bottom wall of a stacked loaded container. Therefore, in stacking these containers, the point loading of stacked containers is overcome.

As mentioned, the container may be made out of various types of moldable and formable materials such as plastics and light metals. Preferred types of plastics are high density polyethylene, polypropylene and copolymers thereof which can withstand repeated washings so that the containers are re-usable.

The container can be readily used in the field to contain picked produce, in turn passed through washing machines to wash the produce and then delivered to a store outlet to display the produce. The produce never need to be taken out of the container after it is picked until the person purchasing the produce does so.

Although various preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. An open-top container adapted to be stacked and nested vertically with a container of substantially identical shape comprising two pairs of opposed interconnected upright walls, each pair of upright walls sloping inwardly toward each other from top to bottom thereof and an interconnected bottom wall, a pair of said upright walls having ventilation means for providing ventilation for the container interior, the bottom wall having drainage means for draining liquid from the container interior, a pair of upright walls each having inwardly projecting flutes extending upwardly from the bottom of the wall and terminating near the top thereof, the upper portion of each flute being closed to present a support surface, stacking guidance means and engagement means being provided on said container, said guidance means being located above said support surfaces and on an inner surface of each wall having said flutes, said engagement means being adapted for engaging stacked containers in a manner to restrict movement between stacked containers in a substantially horizontal plane, and means being provided on said container for precluding an upper container binding in a lower container when like containers are nested one within the other, the arrangement being such that said guidance means is adapted to guide the stacking of an upper container down onto a lower container by the interaction between said guidance means of a lower container and a lower portion of the outer surface of a corresponding upper container upright walls whereby said engagement means of the upper and lower containers are in register.

2. A container as claimed in claim 1 wherein said engagement means comprises a stacking projection provided on each said support surface and which is spaced from the inner surface of the respective upright wall and stacking recesses provided in said bottom wall adjacent the edge of each upright wall having said flutes, the arrangement being such that the stacking recesses of an upper container are in register with and are adapted to receive the stacking projections of a lower container when like containers are stacked.

3. A container as claimed in claim 2 wherein said guidance means comprises a guidance rib integral with each said respective upright wall and extending outwardly towards each said stacking projection, each guidance rib being adapted to guide an upper container down onto a lower container by interaction between an outer free end of each said guidance rib and the outer surface of the corresponding upright wall of an upper container in a manner which aligns each said stacking projection of a lower container with the respective said stacking recess of an upper container.

4. A container as claimed in claim 2 wherein said stacking projection has a raised portion, each said stacking recess being adapted to receive the respective raised portion when like containers are stacked.

5. A container as claimed in claim 3 wherein said stacking projection is an elongate lug having a raised portion, the base of the lug being positioned at substantially right angles to the outwardly extending portion of said guidance rib, each said stacking recess being adapted to receive the respective lug when like containers are stacked.

6. A container as claimed in claim 1 wherein said means for precluding binding between nested containers comprises rib means located on the exterior surface of at least two of said upright walls, said rib means as it is provided on an upper container is adapted to contact an upper edge of the corresponding upright walls of a lower container when like containers are nested one within the other.

7. A container as claimed in claim 1 wherein said means for precluding binding between nested containers comprises ledge means located on the interior surface of at least two of said upright walls at the lower portion thereof which is adapted to contact the exterior surface of an upper container nested in a lower container in a manner to preclude binding between the nested containers.

8. A container as claimed in claim 2 wherein said guidance rib extends outwardly a distance such that the clearance between a free end of the guidance rib and the outer surface of the respective end wall of an upper stacked container is such that said stacking projection of a lower container is aligned with the respective stacking recess of an upper container.

9. A container as claimed in claim 1 wherein said flutes in each said upright wall are spaced apart from one another symmetrically about the central vertical axis of the respective upright wall.

10. A container as claimed in claim 1 wherein said ventilation means is a plurality of spaced-apart slots cut in a pair of opposed upright walls.

11. A container as claimed in claim 1 wherein said drainage means is a plurality of spaced apart perforations cut in the bottom wall.

* * * * *